US010273846B2

(12) United States Patent
Baensch et al.

(10) Patent No.: US 10,273,846 B2
(45) Date of Patent: Apr. 30, 2019

(54) ELECTRIC EXHAUST-GAS CATALYTIC CONVERTER, VEHICLE AND METHOD FOR OPERATING AN ELECTRIC EXHAUST-GAS CATALYTIC CONVERTER

(71) Applicant: CONTINENTAL AUTOMOTIVE GMBH, Hannover (DE)

(72) Inventors: Simon Baensch, Pfakofen (DE); Thomas Knorr, Tegernheim (DE)

(73) Assignee: Continental Automotive GmbH, München (DE)

( * ) Notice: Subject to any disclaimer, the term of this patent is extended or adjusted under 35 U.S.C. 154(b) by 9 days.

(21) Appl. No.: 15/652,405

(22) Filed: Jul. 18, 2017

(65) Prior Publication Data

US 2018/0023442 A1 Jan. 25, 2018

(30) Foreign Application Priority Data

Jul. 25, 2016 (DE) ..... 10 2016 213 612

(51) Int. Cl.

| | |
|---|---|
| ***F01N 3/20*** | (2006.01) |
| ***F01N 9/00*** | (2006.01) |
| ***H05B 1/02*** | (2006.01) |
| ***F01N 3/28*** | (2006.01) |

(52) U.S. Cl.

CPC ..... *F01N 3/2013* (2013.01); *F01N 3/28* (2013.01); *F01N 9/00* (2013.01); *H05B 1/0236* (2013.01); *F01N 2900/08* (2013.01)

(58) Field of Classification Search

CPC ..... F01N 3/0842; F01N 3/0814; F01N 3/027; F01N 3/035; F01N 3/103; F01N 3/2026; F01N 3/2006; F01N 3/2013; F01N 3/28; F01N 9/00; F01N 13/009; F01N 2900/08; F01N 2900/0602; F01N 2240/16; H05B 1/0236

USPC ..... 60/274, 275, 286, 295, 299, 300, 303

See application file for complete search history.

(56) References Cited

U.S. PATENT DOCUMENTS

| | | | | |
|---|---|---|---|---|
| 6,641,795 | B2 * | 11/2003 | Abe | B01J 12/007 423/437.2 |
| 7,245,846 | B2 * | 7/2007 | Seorl | G03G 15/11 399/93 |
| 9,968,886 | B2 * | 5/2018 | Balenovic | F01N 9/00 |
| 2002/0081253 | A1 * | 6/2002 | Abe | B01J 12/007 422/211 |
| 2005/0244183 | A1 * | 11/2005 | Seorl | G03G 15/11 399/93 |

(Continued)

FOREIGN PATENT DOCUMENTS

| | | |
|---|---|---|
| DE | 202015104421 | 8/2015 |

OTHER PUBLICATIONS

German Office Action dated Apr. 5, 2017 for corresponding German Patent Application No. 10 2016 213 612.7.

*Primary Examiner* — Mark A Laurenzi
*Assistant Examiner* — Dapinder Singh

(57) ABSTRACT

The disclosure relates to an electric exhaust-gas catalytic converter that has a heating device. The heading device includes a first heating element and a second heating element that are arranged separately from one another upstream and downstream of an active catalysis region of the electric exhaust-gas catalytic converter. The disclosure also relates to a vehicle which includes the electric exhaust-gas catalytic converter and to a method for operating the electric exhaust-gas catalytic converter.

5 Claims, 2 Drawing Sheets

22

(56) References Cited

U.S. PATENT DOCUMENTS

2010/0290957 A1* 11/2010 Yoshida ..... F01N 3/106
422/109
2012/0060471 A1* 3/2012 Gonze ..... F01N 3/035
60/274

* cited by examiner

ELECTRIC EXHAUST-GAS CATALYTIC CONVERTER, VEHICLE AND METHOD FOR OPERATING AN ELECTRIC EXHAUST-GAS CATALYTIC CONVERTER

CROSS-REFERENCE TO RELATED APPLICATIONS

This application claims priority to German Application DE 10 2016 213 612.7, filed Jul. 25, 2016. The disclosure of the above application is incorporated herein by reference.

Technical Field

The disclosure relates to an electric exhaust-gas catalytic converter, to a vehicle having the electric exhaust-gas catalytic converter, and to a method for operating the electric exhaust-gas catalytic converter.

Background

Exhaust-gas catalytic converters are provided in particular in vehicles with a combustion motor for the purposes of performing exhaust-gas after-treatment to thereby considerably reduce pollutant emissions in an exhaust gas from an internal combustion engine of the combustion motor. Here, a chemical conversion of combustion pollutants by oxidation or reduction of the respective pollutant is performed in the exhaust-gas catalytic converter. For this purpose, the exhaust-gas catalytic converter generally has an active catalysis region in which the chemical conversion—catalysis—is performed.

The required operating temperature normally lies in a region of approximately 500° C., because the catalysis, which is performed in the active catalysis region, requires a certain minimum temperature for effective exhaust-gas after-treatment.

To satisfy ever more stringent exhaust-gas legislation, hybridization is for example a possibility in the case of which, by contrast to a purely combustion-motor-powered vehicle, the combustion motor is as far as possible not operated (in the case of a hybrid vehicle or mild hybrid vehicle). This however results in a greater proportion of vehicle movements with a cold combustion motor.

Therefore, to bring the exhaust-gas catalytic converter to the desired operating temperature quickly, combustion-based measures are for example implemented, which however leads to increased fuel consumption. Altogether, a greater proportion of cold starts leads to increased cold-start emissions and thus also to increased fuel consumption. It is however alternatively possible to use an electric exhaust-gas catalytic converter which has a dedicated heating device which is electrically operated and which can bring the exhaust-gas catalytic converter to the desired operating temperature.

SUMMARY

Therefore, it is desirable to have an electric exhaust-gas catalytic converter that can be operated particularly efficiently. One aspect of the disclosure provides an electric exhaust-gas catalytic converter for a vehicle which has an internal combustion engine. The electric exhaust-gas catalytic converter includes an active catalysis region for reduction and/or oxidization of at least one exhaust gas which is generated in the internal combustion engine and which flows through the active catalysis region along a flow direction.

The electric exhaust-gas catalytic converter also includes a heating device for heating the catalysis region. The heating device has a first heating element and a second heating element which is arranged separately from the first heating element. Here, the first heating element is arranged upstream of the catalysis region in the flow direction of the exhaust gas and the second heating element is arranged downstream of the catalysis region in the flow direction of the exhaust gas. The electric exhaust-gas catalytic converter also includes a control device for actuating the heating device. The control device actuates the heating device. During operation of the internal combustion engine, the control device actuates only the first heating element for the purposes of heating the catalysis region. When the internal combustion engine is at a standstill, the control device actuates only the second heating element for the purposes of heating the catalysis region.

Implementations of the disclosure may include one or more of the following optional features. In some implementations, the first heating element of the electric exhaust-gas catalytic converter is thus arranged upstream of the active catalysis region in the exhaust-gas flow direction. The active catalysis region is normally formed as a honeycomb body composed of a ceramic, which is coated with a so-called wash coat on which the catalysis takes place. If the first heating element is energized and, in the process, warms up, a small part of the heat energy passes by heat conduction through the housing parts of the exhaust-gas catalytic converter to the inlet of the honeycomb body of monolithic form. A further part of the heat energy passes by convection via the mass flow of the exhaust gas flowing through the active catalysis region to catalytically active monoliths that are arranged in the honeycomb body.

Furthermore, a second heating element is arranged downstream of the active catalysis region in the exhaust-gas flow direction.

If a mass flow of the exhaust gas is now absent because the internal combustion engine is at a standstill and is thus not generating exhaust gas, only the second heating element is heated. It is now possible for heat to ingress from the second heating element into the active catalysis region and thus into the honeycomb body by free convection, despite the absence of an exhaust-gas mass flow. In this way, it is possible even when the internal combustion engine is at a standstill for the active catalysis region to be kept at operating temperature or brought to the operating temperature for the first time. The operating temperature may be attained already before the internal combustion engine is started.

In some examples, the electric exhaust-gas catalytic converter is oriented such that the flow direction of the exhaust gas flowing through the active catalysis region is arranged parallel to and in the direction of the first force vector of Earth's gravity. Therefore, when the second heating element is activated, a convection flow upward, that is to say counter to Earth's gravitational force, is achieved, and thus heated ambient air flows upward into the active catalysis region, and thus heats the latter, as a result of the convection.

If only the first heating element upstream of the catalysis region were provided, it would be possible for the heat generated by the first heating element to be captured and transferred into the honeycomb body only with a sufficient exhaust-gas mass flow. By contrast to this, free convection is now additionally utilized, in the case of which the heat rises upward into the active catalysis region, where no exhaust-gas mass flow of the combustion motor is needed for this process.

Another aspect of the disclosure provides a vehicle that has an internal combustion engine having a reciprocating piston which does not move when the internal combustion engine is at a standstill and which moves in translational fashion along a piston longitudinal axis when the internal combustion engine is in operation for the purposes of driving the vehicle. The internal combustion engine generates an exhaust gas during operation. Furthermore, the vehicle has an exhaust tract for discharging the exhaust gas that is generated in the internal combustion engine during operation into an environment. An electric exhaust-gas catalytic converter as described above is arranged in the exhaust tract.

Here, the electric exhaust-gas catalytic converter is advantageously arranged parallel to the piston longitudinal axis such that the exhaust gas flows firstly through the first heating element, then through the active catalysis region and then through the second heating element.

If an electric exhaust-gas catalytic converter is arranged vertically, specifically such that a first heating element is positioned upstream and a second heating element is positioned downstream of the active catalysis region, i.e., the honeycomb body, only the lower heating element, i.e., the second heating element, is heated when the internal combustion engine is at a standstill. During operation of the internal combustion engine, only the upper heating element, i.e., the first heating element, is heated. During operation, an exhaust-gas mass flow is introduced by the exhaust tract into the electric exhaust-gas catalytic converter, where the flowing exhaust gas is heated by the first heating element and the heat ingresses into the active catalysis region. Heating by the second heating element is thus no longer needed. However, if the internal combustion engine is at a standstill and no exhaust-gas mass flow is present, only the second heating element is heated, where, owing to the vertical arrangement of the electric exhaust-gas catalytic converter, the active catalysis region is, overall, heated from below by convection. Heating by the first heating element is not necessary in this case.

Another aspect of the disclosure provides a method for operating an electric exhaust-gas catalytic converter for a vehicle which has an internal combustion engine. Firstly, an electric exhaust-gas catalytic converter as described above is provided, which has a first heating element and a second heating element that are arranged separately from one another upstream and downstream of an active catalysis region. Then, it is detected whether the internal combustion engine is in an operating state or in a standstill state. Then, only the first heating element is actuated if the internal combustion engine is in the operating state, or only the second heating element is actuated if the internal combustion engine is in the standstill state.

The operating temperature of the exhaust-gas catalytic converter can thus be attained in a particularly effective manner already before the starting of the internal combustion engine.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
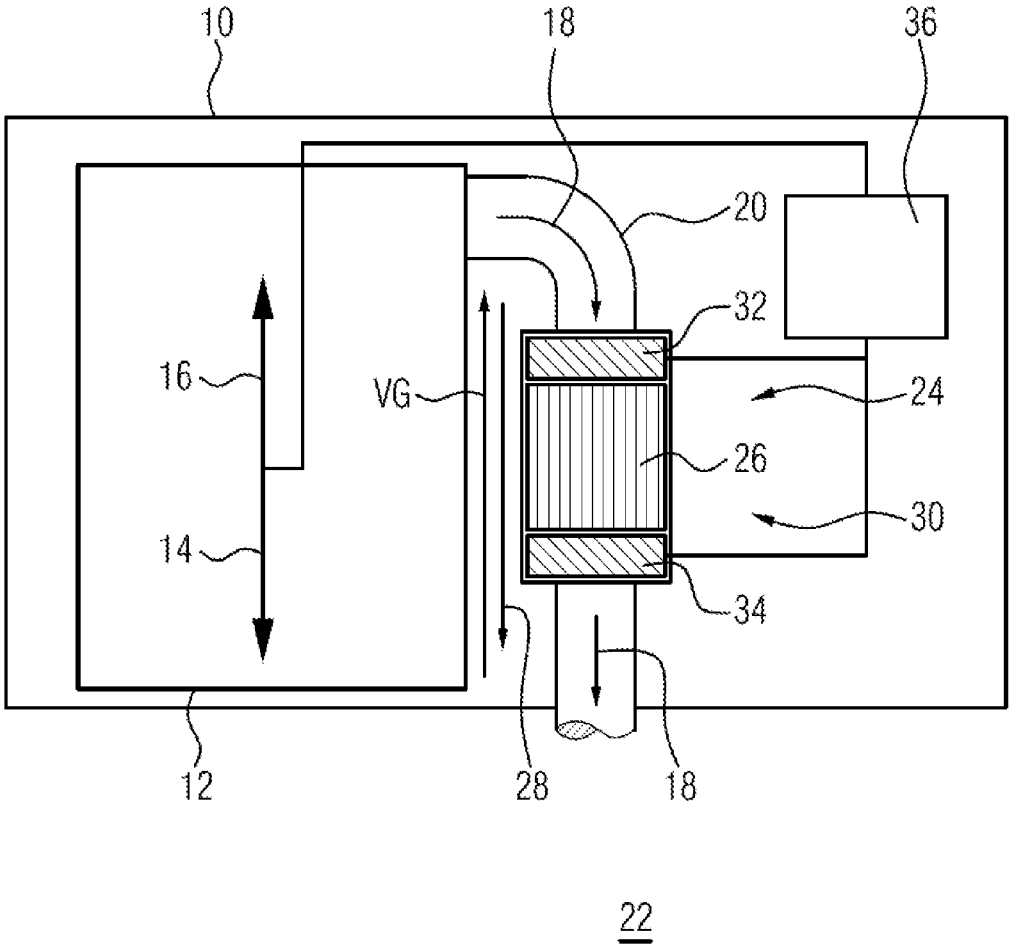
FIG. 1 is a schematic illustration of a vehicle having an internal combustion engine and an exhaust tract having an electric exhaust-gas catalytic converter.

FIG. 1 is a schematic illustration of a vehicle 10 that has an internal combustion engine 12. During operation of the internal combustion engine 12, a reciprocating piston 14 in the internal combustion engine 12 moves in translational fashion along a piston longitudinal axis 16 for the purposes of driving the vehicle 10. However, when the internal combustion engine 12 is at a standstill, the reciprocating piston 14 does not move. During operation of the internal combustion engine 12, exhaust gas 18 is produced which is discharged from the internal combustion engine 12 via an exhaust tract 20 into an environment 22 around the vehicle 10.

To be able to discharge the exhaust gas 18 substantially without pollutants into the environment 22, effective exhaust-gas after-treatment is necessary, which is performed by an electric exhaust-gas catalytic converter 24 arranged in the exhaust tract 20. For this purpose, the exhaust-gas catalytic converter 24 has an active catalysis region 26 in which the exhaust gas 18 or pollutants in the exhaust gas 18 can be oxidized or reduced when the exhaust gas 18 flows through the active catalysis region 26 along a flow direction 28.

For the catalysis to take place in the active catalysis region 26, it is necessary for the active catalysis region 26 to be at a certain operating temperature. To reach the operating temperature, a heating device 30 is provided which can actively heat the active catalysis region 26. For this purpose, the heating device 30 has two heating elements 32, 34 arranged separately from one another in the exhaust-gas catalytic converter 24. Here, a first heating element 32 is arranged upstream of the active catalysis region 26 in the flow direction 28 of the exhaust gas 18, and a second heating element 34 is arranged downstream of the active catalysis region 26 in the flow direction 28 of the exhaust gas 18. The exhaust gas 18 therefore flows in the exhaust tract 20 firstly through the first heating element 32, then through the active catalysis region 26 and subsequently through the second heating element 34.

Furthermore, a control device 36 is provided in the vehicle 10. The control device 36 can actively actuate the heating device 30 and thus the two heating elements 32, 34.

As shown in FIG. 1, the exhaust-gas catalytic converter 24 is arranged vertically and thus parallel to and in the direction of the force vector of Earth's gravity VG. Accordingly, the exhaust gas 18 flows out of the exhaust-gas catalytic converter 24 along the force vector of Earth's gravity VG.

In some implementations, if the internal combustion engine 12 is at a standstill, no exhaust gas 18 is produced, and accordingly, there is also no exhaust-gas mass flow that can flow through the exhaust-gas catalytic converter 24 and thus through the active catalysis region 26. The active catalysis region 26 therefore cannot be heated by the first heating element 32 by forced convection of the exhaust gas 18. Therefore, in this standstill-state situation, only the second heating element 34 is actuated and thus activated. In some examples, free convection, ambient air is heated in the second heating element 23 and flows in a direction counter to the force vector of Earth's gravity VG from the second heating element 34 into the active catalysis region 26, and thus heats the active catalysis region 26 to the desired operating temperature.

During operation of the internal combustion engine 12, the exhaust-gas mass flow is present, such that the first heating element 32 is actuated and thus activated and heats the exhaust-gas mass flow, which then heats the catalysis region 26 by forced convection.

Figure 2:
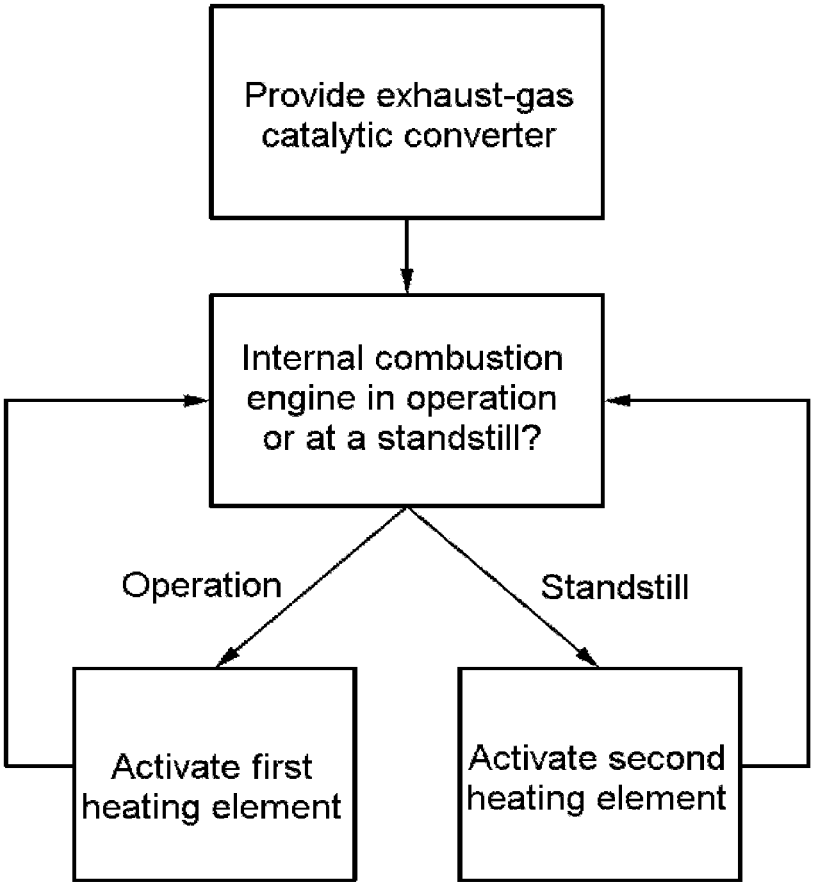
FIG. 2 is a schematic illustration of steps of a method for operating the electric exhaust-gas catalytic converter from FIG. 1.

FIG. 2 is a schematic illustration of method steps of a method with which the electric exhaust-gas catalytic converter 24 may be operated.

Here, firstly, the electric exhaust-gas catalytic converter 24 shown in FIG. 1 is provided, which has not only the active catalysis region 26 but also a first heating element 32 and a second heating element 34 which are arranged separately from one another upstream and downstream of the active catalysis region 26. It is then detected whether the internal combustion engine 12 is in an operating state or at a standstill.

If the internal combustion engine 12 is in an operating state, the first heating element 32 is actuated and thus activated in order to heat the exhaust-gas mass flow, which is produced as a result of the operation of the internal combustion engine 12, and simultaneously bring the active catalysis region 26 to operating temperature by forced convection.

However, if it is detected that the internal combustion engine 12 is at a standstill, only the second heating element 34 is actuated and thus activated in order to heat ambient air by means of free convection, which ambient air flows from below through the active catalysis region 26 and thus heats the latter to operating temperature.

The method steps are performed continuously to be able to continuously identify which of the two heating elements 32, 34 should presently ideally be actuated.

A number of implementations have been described. Nevertheless, it will be understood that various modifications may be made without departing from the spirit and scope of the disclosure. Accordingly, other implementations are within the scope of the following claims.

What is claimed is:

1. An electric exhaust-gas catalytic converter for a vehicle having an internal combustion engine, the electric exhaust-gas catalytic converter comprising:

an active catalysis region configured to reduce and/or oxidize at least one exhaust gas which is generated in the internal combustion engine and which flows through the active catalysis region along a flow direction;

a heating device configured to heat the catalysis region, the heating device has a first heating element and a second heating element which is arranged separately from the first heating element, the first heating element is arranged upstream of the catalysis region in the flow direction of the exhaust gas and the second heating element is arranged downstream of the catalysis region in the flow direction of the exhaust gas; and a control device configured to actuate the heating device wherein:

during operation of the internal combustion engine, the control device actuates only the first heating element for heating the catalysis region; and when the internal combustion engine is at a standstill, the control device actuates only the second heating element for heating the catalysis region.

2. The electric exhaust-gas catalytic converter of claim 1, wherein the flow direction of the exhaust gas flowing through the active catalysis region is arranged parallel to and in the direction of the force vector of Earth's gravity.

3. A vehicle comprising:

an internal combustion engine having a reciprocating piston, the reciprocating piston does not move when the internal combustion engine is at a standstill, and the reciprocating piston moves in translational fashion along a piston longitudinal axis when the internal combustion engine is in operation, wherein the internal combustion engine generates an exhaust gas during operation; and an exhaust tract for discharging the exhaust gas which is generated in the internal combustion engine during operation into an environment, the exhaust tract comprising an electric exhaust-gas catalytic converter having:

an active catalysis region configured to reduce and/or oxidize at least one exhaust gas which is generated in the internal combustion engine and which flows through the active catalysis region along a flow direction;

a heating device configured to heat the catalysis region, the heating device has a first heating element and a second heating element which is arranged separately from the first heating element, the first heating element is arranged upstream of the catalysis region in the flow direction of the exhaust gas and the second heating element is arranged downstream of the catalysis region in the flow direction of the exhaust gas; and a control device configured to actuate the heating device such that, during operation of the internal combustion engine, only the first heating element is actuated for heating the catalysis region, and that, when the internal combustion engine is at a standstill, only the second heating element is actuated for heating the catalysis region.

4. The vehicle of claim 3, wherein that the electric exhaust-gas catalytic converter is arranged parallel to the piston longitudinal axis such that the exhaust gas flows firstly through the first heating element, then through the active catalysis region and then through the second heating element.

5. A method for operating an electric exhaust-gas catalytic converter for a vehicle having an internal combustion engine, the method comprising:

providing an electric exhaust-gas catalytic converter having a first heating element and a second heating element which are arranged separately from one another upstream and downstream of an active catalysis region;

detecting whether the internal combustion engine is in an operating state or is in a standstill state; and actuating only the first heating element if the internal combustion engine is in the operating state, or actuating only the second heating element if the internal combustion engine is in the standstill state, wherein the electric exhaust-gas catalytic converter comprises:

an active catalysis region configured to reduce and/or oxidize at least one exhaust gas which is generated in the internal combustion engine and which flows through the active catalysis region along a flow direction;

a heating device configured to heat the catalysis region, the heating device has the first heating element and the second heating element which is arranged separately from the first heating element, the first heating element is arranged upstream of the catalysis region in the flow direction of the exhaust gas and the second heating element is arranged downstream of the catalysis region in the flow direction of the exhaust gas; and a control device configured to actuate the heating device such that, during operation of the internal combustion engine, only the first heating element is actuated for heating the catalysis region, and that, when the internal combustion engine is at a standstill, only the second heating element is actuated for heating the catalysis region.

* * * * *